US006353415B1

(12) United States Patent
Ashtiani et al.

(10) Patent No.: US 6,353,415 B1
(45) Date of Patent: Mar. 5, 2002

(54) MOLDED IN PLACE ANTENNA ASSEMBLY AND METHOD OF MAKING SAME

(75) Inventors: Mansour Ashtiani, Beverly Hills; David Wayne Whitehead, Rochester Hills, both of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/711,423

(22) Filed: Nov. 13, 2000

(51) Int. Cl.[7] ..... H01Q 1/32
(52) U.S. Cl. ..... 343/713
(58) Field of Search ..... 343/703, 711, 343/712, 713, 716, 873; H01Q 1/32

(56) References Cited

U.S. PATENT DOCUMENTS 3,576,576 A * 4/1971 Jensen ..... 343/712
3,638,225 A * 1/1972 Zawodniak ..... 343/713
3,680,132 A * 7/1972 Tolliver ..... 343/713
3,731,202 A * 5/1973 Meyers ..... 325/357
3,779,878 A * 12/1973 Swift et al. ..... 204/140
3,816,836 A * 6/1974 Smith ..... 343/713
3,816,837 A 6/1974 Smith ..... 343/713
3,987,449 A * 10/1976 DeAngelis et al. ..... 343/713
4,086,595 A * 4/1978 Cherenko et al. ..... 343/713
4,804,967 A * 2/1989 Ohe et al. ..... 343/712
6,164,548 A * 12/2000 Curiel ..... 235/487

* cited by examiner

*Primary Examiner*—Tho Phan
(74) *Attorney, Agent, or Firm*—Patrick M. Griffin

(57) ABSTRACT

A molded in place antenna assembly and method of making same for attachment to structure of a vehicle includes an antenna and a carrier formed from a plastic material for attachment to the structure of the vehicle and incorporating the antenna within the plastic material.

19 Claims, 3 Drawing Sheets

MOLDED IN PLACE ANTENNA ASSEMBLY AND METHOD OF MAKING SAME

TECHNICAL FIELD

The present invention relates generally to antennas for vehicles and, more particularly, to a molded in place antenna assembly for a vehicle and method of making same.

BACKGROUND OF THE INVENTION

It is known to provide an antenna for a vehicle such as an automotive vehicle to collect radio waves. Typically, the antenna is adhesively laminated to a windshield or headliner of or exterior mounted to the vehicle. However, it is known to provide an antenna for an instrument panel. An example of such an antenna is disclosed in U.S. Pat. No. 3,816,837 to Smith. In that patent, a radio antenna is combined with an instrument panel for an automotive vehicle. The instrument panel assembly includes a metal conductor in the form of a metal coating sprayed onto a non-conductive top portion of a rigid insert within the instrument panel assembly for collecting radio waves directly through the windshield opening from outside the vehicle to thereby provide an antenna for a radio receiver.

However, it is desirable to reduce the number of components and costs associated with the purchase and assembly of the antenna assembly. It is also desirable to insert mold an antenna for a vehicle. Therefore, there is a need in the art to provide a molded in place antenna assembly and method for making same for a vehicle.

SUMMARY OF THE INVENTION

It is, therefore, one object of the present invention to provide a new molded in place antenna assembly for a vehicle.

It is another object of the present invention to provide a method of molding in place an antenna that is incorporated into an interior trim component for a vehicle.

To achieve the foregoing objects, the present invention is a molded in place antenna assembly for attachment to structure of a vehicle including an antenna. The molded in place antenna assembly also includes a carrier formed from a plastic material for attachment to the structure of the vehicle and incorporating the antenna within the plastic material.

In addition, the present invention is a method of making a molded in place antenna assembly for attachment to structure of a vehicle. The method includes the steps of placing an antenna into a cavity of a mold and filling the cavity with a plastic material. The method also includes the steps of introducing steam into the mold to expand the plastic material to form a carrier with the antenna disposed within the carrier and bonding the carrier against the antenna to form a single molded in place antenna assembly.

One advantage of the present invention is that a new molded in place antenna assembly and method of making the molded in place antenna assembly is provided for a vehicle. Another advantage of the present invention is that the method of making the molded in place antenna assembly provides an antenna insert molded into an expanded polypropylene interior panel or component. Yet another advantage of the present invention is that the method of making the molded in place antenna assembly reduces assembly operations, the number of separate components, labor, cost and tooling for the same. Still another advantage of the present invention is that the method of making a molded in place antenna assembly reduces material, mass and costs. A further advantage of the present invention is that the method allows antenna connection components to be greatly simplified such as shorter wires with less routing. Yet a further advantage of the present invention is that the method allows the actual connection (plugging in) to be greatly simplified or eliminated.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
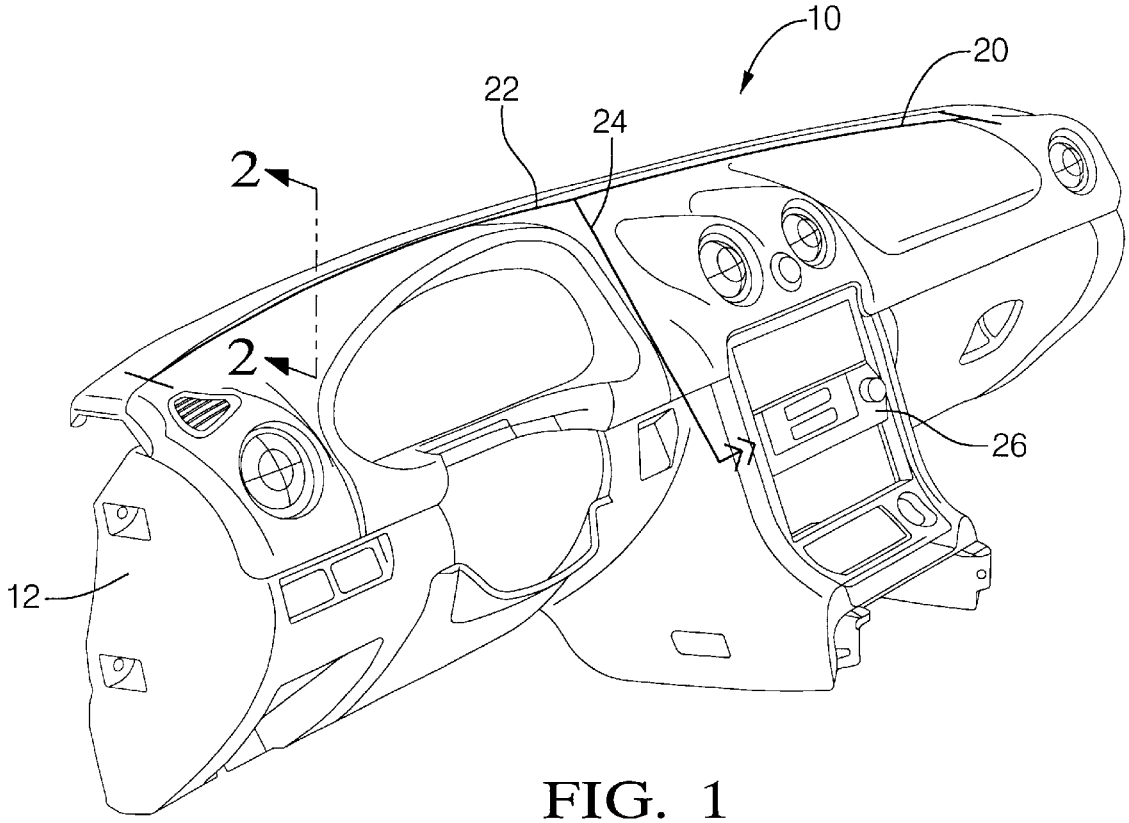
FIG. 1 is a perspective view of a molded in place antenna assembly, according to the present invention, illustrated in operational relationship with a vehicle.
Figure 2:
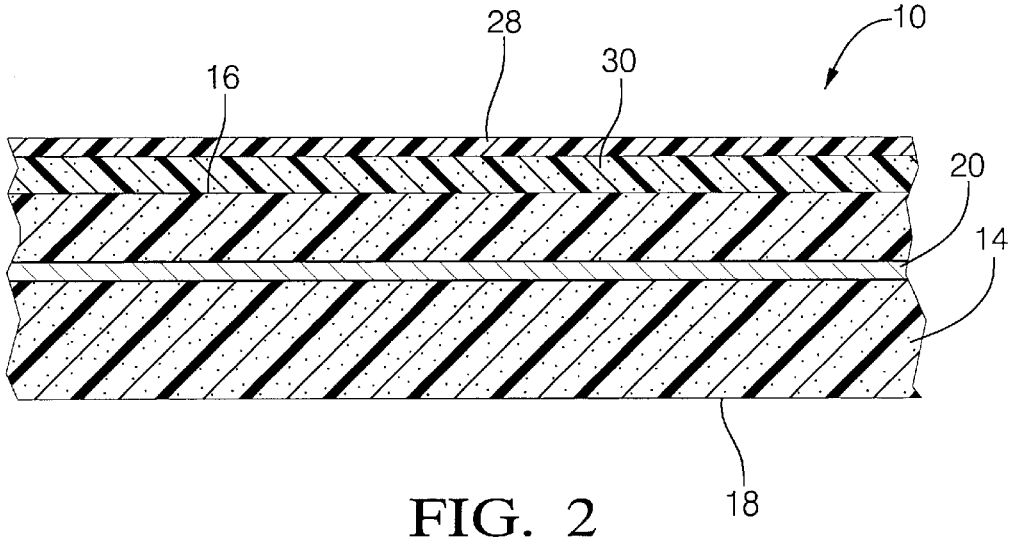
FIG. 2 is a sectional view of the molded in place antenna assembly taken along line 2—2 of FIG. 1.

Referring to the drawings and in particular FIGS. 1 and 2, one embodiment of a molded in place antenna assembly 10, according to the present invention, is shown mounted to structure of a vehicle (not shown). It should be appreciated that, in this example, the molded in place antenna assembly 10 is a topper pad mounted to an instrument panel 12 of the vehicle. It should also be appreciated that the molded in place antenna assembly 10 may be an assembly mounted to other structure or panels of the vehicle such as a packing shelf, "C" pillar, headliner, bumper core, and sun shade.

The molded in place antenna assembly 10 includes a carrier 14 extending longitudinally and transversely and having a generally rectangular shape. The carrier 14 is made of an expanded plastic material such as expanded polypropylene, expanded polyethylene, or expanded polystyrene. Preferably, the carrier 14 is made of expanded polypropylene. The carrier 14 is formed by a method, according to the present invention, to be described. The carrier 14 has an upper side 16 and a lower side 18. The lower side 18 is attached to the instrument panel 12 by suitable means such as fasteners (not shown).

The molded in place antenna assembly 10 includes an antenna 20 disposed in the carrier 14. The antenna 20 has at least one first wire 22 extending transversely and at least one second wire 24 extending longitudinally from the first wire 22 for connection to an electronic device such as a radio 26. The antenna 20 is a relatively flexible preformed material having a melting point greater than material for the carrier 14. It should be appreciated that the antenna 20 may have electromagnetic interference (EMI) or radio frequency interference (RFI) shielding when embedded in the carrier 14.

The antenna 20 may be located near the lower side 18 of the carrier 14 or the antenna 20 may be located near the upper side 16 of the carrier 14. The antenna 20 may be located at any point between the lower side 18 and upper side 16 of the carrier 14 as illustrated in FIG. 2. It should be appreciated that the antenna 20 may be any combination of the locations just described. It should also be appreciated that the antenna 20 is a perform structure having a heat activated adhesive thereon that will be activated by steam to ensure long term stability of the expanded polypropylene material of the carrier 14.

The molded in place antenna assembly 10 also includes a plurality of components incorporated or integrated into the carrier 14. The components may include a finished cover or interior trim substrate 28. The interior trim substrate 28 extends longitudinally and transversely and is generally rectangular in shape. The carrier 14 conforms to the shape of the interior trim substrate 28 such that the carrier 14 is disposed within the interior trim substrate 28. The interior trim substrate 28 is made of a relatively rigid material such as hard plastic, covered plastic, and covered cellulose based material or composite of the like. The covering can be fabric, vinyl, cloth, TPO, leather, or carpet. The interior trim substrate 28 is formed by a suitable thermoplastic molding or forming process such as injection molding, compression molding, thermoforming or the like. It should be appreciated that the interior trim substrate 28 is a separate piece or component.

The components may also include a foam layer 30 disposed between the interior trim substrate 28 and the carrier 14. The foam layer 30 extends longitudinally and vertically in shape. The foam layer 30 is made of a plastic material such as polypropylene. It should be appreciated that the foam layer 30 and interior trim substrate 28 are facing materials and are optional.

Figure 3:
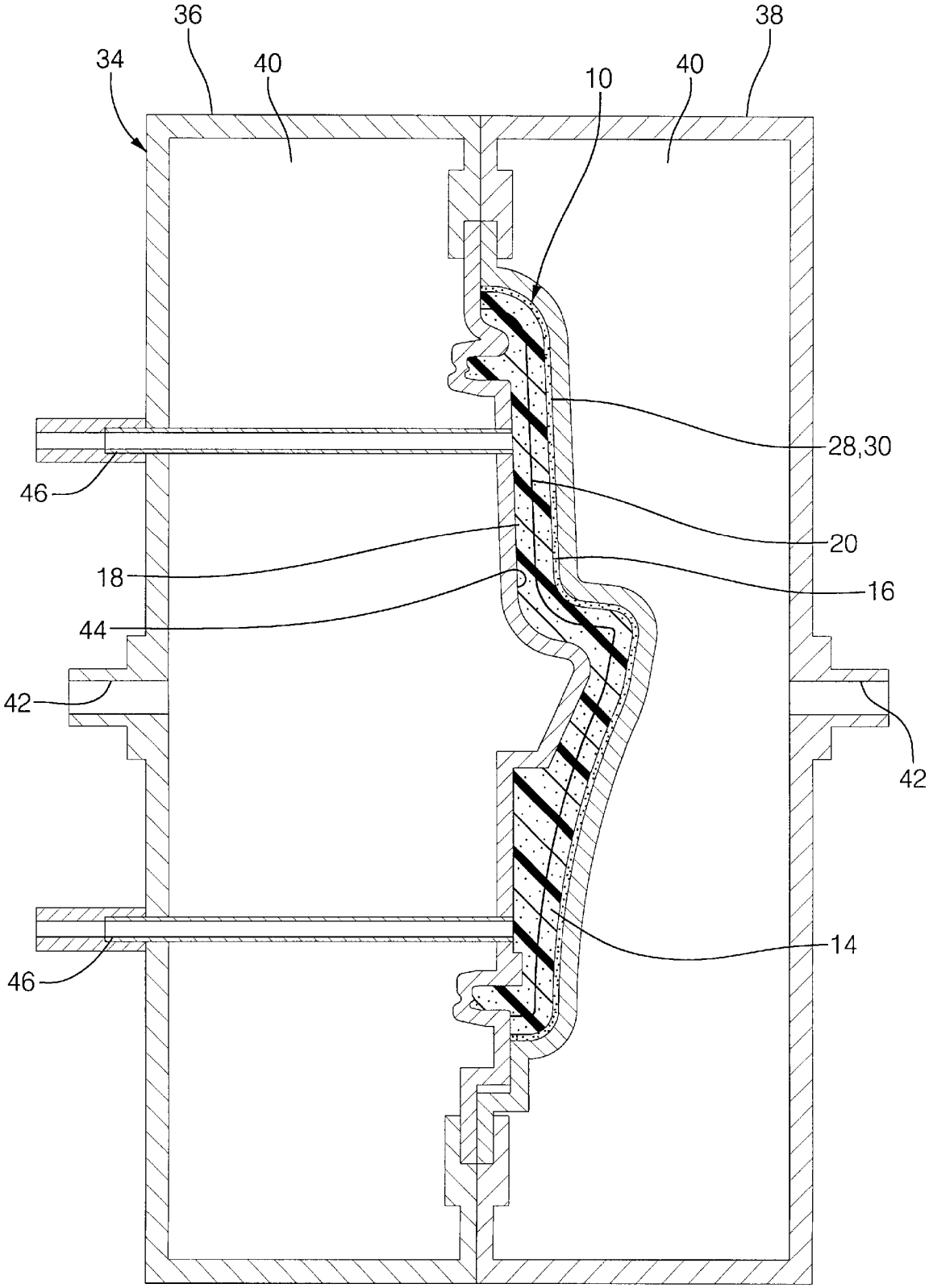
FIG. 3 is a fragmentary side view of a mold used in a method, according to the present invention, of making the molded in place antenna assembly of FIG. 1.
Figure 4:
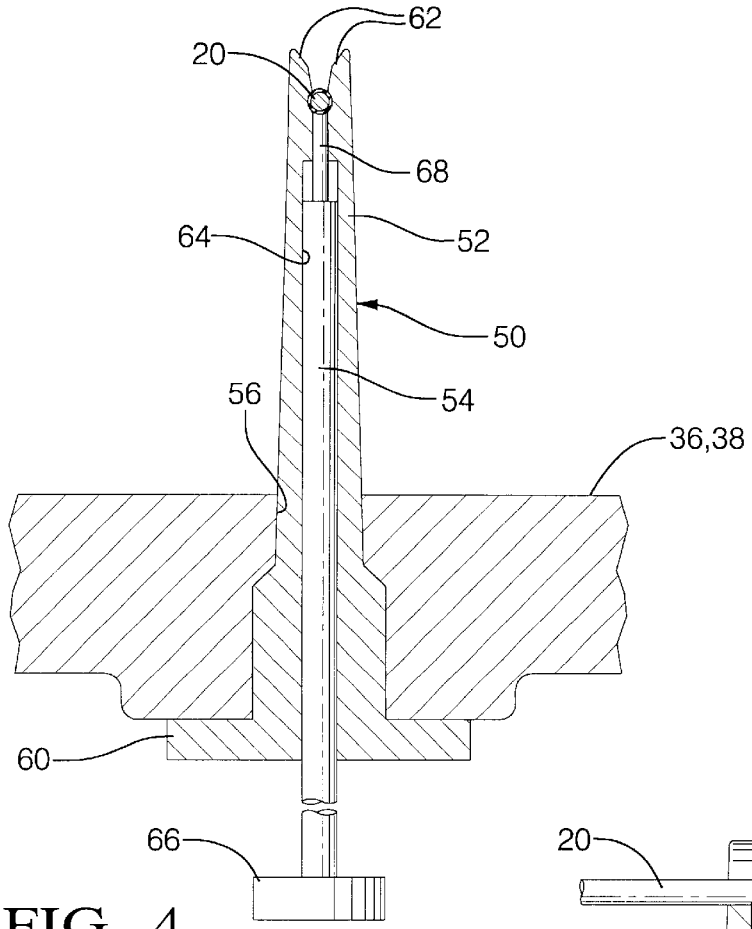
FIG. 4 is a fragmentary side view of a retention tool used with the mold of FIG. 3.
Figure 5:
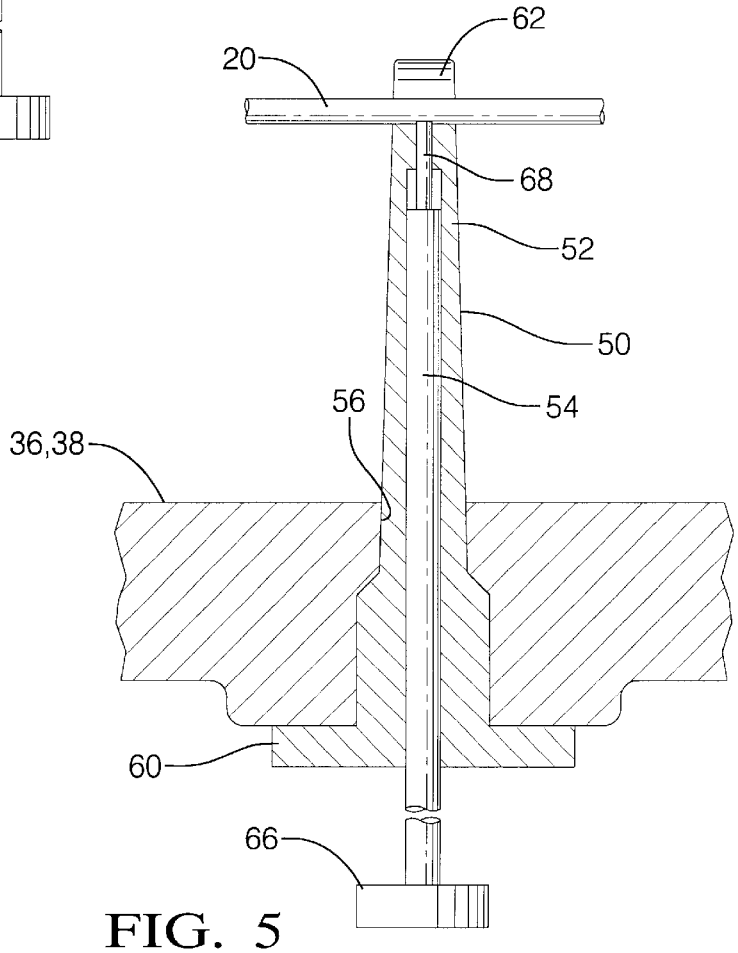
FIG. 5 is a fragmentary front view of the retention tool used with the mold of FIG. 3

Referring to FIGS. 3 through 5, a method, according to the present invention, of making the molded in place antenna assembly 10 is disclosed. As illustrated in FIG. 3, a mold, generally indicated at 34, of a steam chest type includes a first half mold 36 and a second half mold 38. The first and second half molds 36 and 38 are generally hollow to form a chamber 40. The first and second half molds 36 and 38 have an inlet 42 for allowing a fluid such as steam to enter the chamber 40 of the first and second half molds 36 and 38. The first and second half molds 36 and 38 each include a mold cavity 44 for forming the carrier 14. The first half mold 36 includes at least one, preferably a plurality of fill inlets 46 extending into the mold cavity 40 to allow fill guns to fill the mold cavity 44 with the plastic material for the carrier 14. It should be appreciated that the mold 34 is conventional and known in the art.

The method, according to the present invention, may include the step of forming the interior trim substrate 28 by conventional processes such as injection molding or other suitable thermoplastic molding or forming process (i.e., compression molding, thermoforming, etc.). The interior trim substrate 28 is preferably designed with at least one, preferably a plurality of "undercut" members to facilitate mechanical bonding of the carrier 14. The method includes the step of preheating the interior trim substrate 28 using an infrared oven (not shown) or the like. Preferably, the interior trim substrate 28 would be demolded from the injection molder (not shown) at higher-than-ambient temperature and placed into the cavity 44 of the mold 34.

The method may include the step of placing the interior trim substrate 28 into the cavity 44 of the mold 34. The method may include the step of placing the foam layer 30 into the cavity of the mold 34 and retaining the foam layer 30 using known retention methods. The method includes the step of placing the antenna 20 into the cavity 44 of the mold 34 and retaining the antenna 20 within the cavity 44.

As illustrated in FIGS. 4 and 5, the mold 34 includes an antenna retention tool, generally indicated at 50, to retain the antenna 20 in the cavity 44. The antenna retention tool 50 includes a retainer post 52 and an ejector 54 cooperating with the retainer post 52. The retainer post 52 is generally cylindrical in shape and extends through an aperture 56 in the half molds 36 and 38. The retainer post 52 has a flange 58 at a lower end to retain the retainer post 52 to the mold 30. The retainer post 52 has a pair of fingers 60 at an upper end to hold and retain the antenna 20. The retainer post 52 has a passageway 62 extending longitudinally therethrough for a function to be described. The ejector 54 is generally cylindrical in shape and extends through the passageway 64. The ejector 54 has a flange 66 at a lower end to prevent the ejector 54 from exiting the passageway 64. The ejector 54 has a tip 68 extending into the fingers 60 to eject the antenna 20 from the fingers 60 when the ejector 54 is actuated or moved relative to the retainer post 52. It should be appreciated that the wire for the antenna 20 could be put into the mold 30 from a continuous spool of wire by a robot (not shown), thereby reducing cost.

The method includes the steps of closing the mold 34 and filling the cavity 44 with the plastic material for the carrier 16. In the preferred embodiment, the plastic material is in the form of thermoplastic beads that are blown into the cavity 44 of the mold 34 and are of a class of beads used in steam chest molding. Preferably, the thermoplastic beads are expanded polypropylene, but may be expanded polyethylene or expanded polystyrene (styrofoam). As such, the cavity 44 is filled with beads of expanded polypropylene blown therein, which enter the mold 34 via the fill inlets 46. It should be appreciated that the apertures 28 in the antenna 22 allow the beads to pass therethrough.

Next, the method includes the step of introducing steam into the mold 34 via the inlets 42 to expand the plastic material and bonding the plastic material to the antenna 22, foam layer 32, and interior trim substrate 30 to form the molded in place antenna assembly 10. In particular, steam enters the chambers 40 of the first and second half molds 34 and 36 through the inlets 42. The beads of expanded polypropylene are fused together with mechanical and thermoplastic bonding occurring to the interior trim substrate 30. It should be appreciated that the steam enters through openings in the second half mold 36, interior trim substrate 30 and first half mold 34 to expand the beads of polypropylene. It should also be appreciated that the expanded polypropylene, as its own insulator, may eliminate the need for insulation on the antenna 20, thereby reducing cost. It should further be appreciated that steam chest molding is conventional and known in the art.

The method may include the step of cooling the mold 34 by spraying a coolant such as water through nozzles (not shown) onto the backside of the cavity 44 of the mold 34. Once the molded in place antenna assembly 10 is cooled or after a suitable time for fusion and cooling, the method includes the step of opening the mold 34 and removing or demolding the molded in place antenna assembly 10 from the mold 34. Finally, the method includes the step of attaching the molded in place antenna assembly 10 to the instrument panel 12 by suitable means such as fasteners, adhesives, heat staking, sonic welding or the like.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A molded in place antenna assembly for attachment to a structure within an interior of a vehicle comprising:

an antenna being a wire;

an interior trim substrate; and a carrier formed from an expanded plastic material for attachment to the structure of the vehicle and incorporating said antenna within said plastic material, said carrier conforming to a shape of said interior trim substrate such that said carrier is disposed within said interior trim substrate.

2. A molded in place antenna assembly as set forth in claim 1 wherein said plastic material is one from a group comprising expanded polypropylene, expanded polyethylene, and expanded polystyrene.

3. A molded in place antenna assembly as set forth in claim 1 wherein said antenna comprises a plurality of wires.

4. A molded in place antenna assembly as set forth in claim 1 wherein said antenna comprises at least one first wire extending transversely and at least one second wire extending longitudinally from said at least one first wire.

5. A molded in place antenna assembly as set forth in claim 1 wherein said carrier has an upper side and a lower side.

6. A molded in place antenna assembly as set forth in claim 5 wherein said antenna is located adjacent said upper side.

7. A molded in place antenna assembly as set forth in claim 5 wherein said antenna is located adjacent said lower side.

8. A molded in place antenna assembly as set forth in claim 5 wherein said antenna is located between said upper side and said lower side.

9. A molded in place antenna assembly as set forth in claim 1 wherein said antenna is made of a thermoplastic material having a melting point greater than said plastic material of said carrier.

10. A method of making a molded in place antenna assembly for attachment to structure of a vehicle, said method comprising the steps of:

placing an interior trim substrate within a cavity of a mold;

placing an antenna into the cavity of the mold;

filling the cavity with a plastic material; and introducing steam into the mold to expand the plastic material to form a carrier with the antenna disposed within the carrier and bonding the carrier to the antenna and the interior trim substrate to form a single molded in place antenna assembly.

11. A method as set forth in claim 10 including the step of providing the antenna as a wire.

12. A method as set forth in claim 11 including the step of retaining the wire within the cavity using an antenna retention tool.

13. A method as set forth in claim 10 wherein said step of filling comprises filling the cavity with a plurality of plastic beads.

14. A method as set forth in claim 13 wherein said step of filling further comprises blowing the plastic beads into the cavity.

15. A method as set forth in claim 13 wherein the plastic beads are either expanded polypropylene beads, expanded polyethylene beads, and expanded polystyrene beads.

16. A method as set forth in claim 13 wherein said step of introducing comprises introducing steam into a chamber behind the cavity to expand the plastic beads.

17. A method as set forth in claim 10 including the step of locating the antenna adjacent an upper side of the carrier.

18. A method as set forth in claim 10 including the step of locating the antenna adjacent a lower side of the carrier.

19. A method as set forth in claim 10 including the step of locating the antenna between an upper side and a lower side of the carrier.

* * * * *